US006759105B2

(12) United States Patent
Brooker et al.

(10) Patent No.: US 6,759,105 B2
(45) Date of Patent: Jul. 6, 2004

(54) WOOD SURFACE INKJET RECEPTOR MEDIUM AND METHOD FOR MAKING AND USING SAME

(75) Inventors: Dennis B. Brooker, P.O. Box 12, Derby, IA (US) 50068; George Cash, Monona, WI (US)

(73) Assignee: Dennis B. Brooker, Derby, IA (US)

( * ) Notice: Subject to any disclaimer, the term of this patent is extended or adjusted under 35 U.S.C. 154(b) by 0 days.

(21) Appl. No.: 10/044,702

(22) Filed: Nov. 9, 2001

(65) Prior Publication Data

US 2002/0061389 A1 May 23, 2002

Related U.S. Application Data

(60) Provisional application No. 60/248,034, filed on Nov. 13, 2000.

(51) Int. Cl.[7] ..... B41M 5/40
(52) U.S. Cl. ..... 428/32.3
(58) Field of Search ..... 428/195, 332, 428/537.1, 541, 704, 32.3

(56) References Cited

U.S. PATENT DOCUMENTS

| | | | | |
|---|---|---|---|---|
| 536,841 A | | 4/1895 | Roenigk | |
| 2,829,081 A | | 4/1958 | Sweem | 154/118 |
| 3,076,833 A | * | 2/1963 | Taylor et al. | 260/438 |
| 3,246,002 A | * | 4/1966 | Gagliardi et al. | 260/299 |
| 4,640,529 A | | 2/1987 | Katz | 281/5 |
| 4,810,006 A | | 3/1989 | Katz | 281/5 |
| 4,913,972 A | * | 4/1990 | Grunewalder et al. | 428/425.5 |
| 4,931,342 A | | 6/1990 | Tolbert et al. | 428/90 |
| 4,942,084 A | | 7/1990 | Prince | 428/384 |
| 4,962,191 A | * | 10/1990 | Puntener et al. | 534/698 |
| 5,194,310 A | | 3/1993 | Lendelink | 428/90 |
| 5,286,547 A | | 2/1994 | Tyerman | 428/195 |
| 5,407,995 A | | 4/1995 | Hintz-Bruning et al. | 524/539 |
| 5,486,231 A | | 1/1996 | Dulaney | 106/243 |
| 5,534,052 A | * | 7/1996 | Mennicke et al. | 106/22 |
| 5,555,642 A | * | 9/1996 | Rem et al. | 34/423 |
| 5,858,487 A | * | 1/1999 | Boehhler et al. | 428/34.3 |
| 5,910,623 A | * | 6/1999 | Kessel et al. | 8/402 |
| 5,945,373 A | * | 8/1999 | Hofmann | 502/407 |
| 6,099,928 A | | 8/2000 | Chee | 428/40.1 |
| 6,143,113 A | * | 11/2000 | Berube | 156/210 |
| 6,183,923 B1 | * | 2/2001 | Kato et al. | 430/96 |
| 6,291,127 B1 | * | 9/2001 | Dagan et al. | 430/201 |

FOREIGN PATENT DOCUMENTS

DE 2745939 A 12/1978

OTHER PUBLICATIONS

DuPont Products Database Search Results for Quilon® Chrome Complex at www.dupont.com. Oct. 31, 2000.
* Abridgement of AU 509450 B2 (1980), Counterpart to DE 2745939A.
Patent Abstracts of Japan for JP 61 41585 (1986).

* cited by examiner

*Primary Examiner*—Cynthia H. Kelly
*Assistant Examiner*—Betelhem Shewareged
(74) *Attorney, Agent, or Firm*—John H. Hornickel

(57) ABSTRACT

Wood surfaces treated to be inkjet receptive media are disclosed, where the wood surface is treated in a manner that can control the spread of an ink droplet reaching the wood surface to provide a superior image graphic. The treatment uses an image fixing agent comprising an aqueous solution of containing an organo-metallic complex of a hydrophobic fatty acid coordinated with a halogenated trivalent chromium. Veneers, plywoods, and particle boards having faces of lesser value woods can be digitally imaged to give the appearance of higher value woods or other customized inkjet images. Environmental and economic considerations benefit from the use of commonly available wood surfaces to simulate exotic and threatened wood species.

11 Claims, 1 Drawing Sheet

(1 of 1 Drawing Sheet(s) Filed in Color)

WOOD SURFACE INKJET RECEPTOR MEDIUM AND METHOD FOR MAKING AND USING SAME

CLAIM OF PRIORITY

This application claims the benefit of provisional application No. 60/248,034, filed on Nov. 13, 2000.

COLOR DRAWING

The file of this patent contains at least one drawing executed in color. Copies of this patent with color drawings will be provided by the Patent and Trademark Office upon request and payment of the necessary fee.

FIELD OF INVENTION

This invention relates to wood surfaces treated to be inkjet receptive media, where the wood surface is treated in a manner that can control the spread of an ink droplet reaching the wood surface to provide a superior image graphic.

BACKGROUND OF INVENTION

Image graphics are omnipresent in modem life. Images and data that warn, educate, decorate, entertain, advertise, etc. are applied on a variety of interior and exterior, vertical and horizontal surfaces. Nonlimiting examples of image graphics range from advertisements on walls or sides of trucks, posters that advertise the arrival of a new movie, to warning signs near the edges of stairways.

The use of thermal and piezo inkjet inks have greatly increased in recent years with accelerated development of inexpensive and efficient inkjet printers, ink delivery systems, and the like.

Thermal inkjet hardware is commercially available from a number of multinational companies, including without limitation, Hewlett-Packard Corporation of Palo Alto, Calif., U.S.A.; Encad Corporation of San Diego, Calif., U.S.A.; Xerox Corporation of Rochester, N.Y., U.S.A.; LaserMaster Corporation of Eden Prairie, Minn., U.S.A.; Mutoh Corporation and Mimaki Engineering Co., Ltd. of Tokyo, Japan. The number and variety of printers changes rapidly as printer makers are constantly improving their products for consumers. Printers are made both in desk-top size and wide format size depending on the size of the finished image graphic desired. Nonlimiting examples of popular commercial scale thermal inkjet printers are Encad's NovaJet Pro printers and H-P's 650C, 750C, and 2500CP printers. Nonlimiting examples of popular wide format thermal inkjet printers include H-P's DesignJet printers.

Minnesota Mining and Manufacturing Company (3M) markets Graphic Maker Inkjet software useful in converting digital images from the Internet, ClipArt, or Digital Camera sources into signals to thermal inkjet printers to print such image graphics.

Inkjet inks are also commercially available from a number of multinational companies such as Hewlett Packard Corporation in the four principal colors: cyan, magenta, yellow, and black (generally abbreviated "CMYK") to permit the formation of as many as 256 colors or more in the digital image.

Media for inkjet printers are also undergoing accelerated development. Because inkjet imaging techniques have become vastly popular in commercial and consumer applications, the ability to use a personal computer to print a color image on paper or other receptor media has extended from dye-based inks to pigment-based inks. And the media must accommodate that change. Pigment-based inks provide more durable images because pigment particles are contained in a dispersion before being dispensed using a thermal inkjet print head.

Inkjet printers have come into general use for wide-format electronic printing for applications, such as engineering and architectural drawings. Because of the simplicity of operation and economy of inkjet printers, this image process holds a superior growth potential promise for the printing industry to produce wide format, image on demand, presentation quality graphics.

Therefore, the components of an inkjet system used for making graphics can be grouped into three major categories:

1 Computer, software, printer with print head and plumbing components.

2 Ink.

3 Receptor medium.

The computer, software, and printer will control the size, number and placement of the ink droplets and will transport the receptor media. The ink will contain the colorant or pigments which form the image and the receptor medium provides the medium which accepts and holds the ink. The quality of the inkjet image graphic is a function of the total system. However, the composition and interaction between the ink and receptor medium is important in an inkjet system only after the ink has traversed the plumbing of the printer and been jetted through the print head without damage to either the print head or the ink.

Image quality is what the viewing public and paying customers will want and demand to see. For the producer of the image graphic, many other obscure demands are also placed on the inkjet media/ink system from the print shop. Also, exposure to the environment can place additional demands on the media and ink (depending on the application of the graphic).

When the inkjet ink drop contacts the receptor medium, a combination of two things occur. The inkjet drop diffuses vertically into the medium and diffuses horizontally along the receptor surface, with a resulting spread of the dot.

Efforts to produce efficient ink receptor media have concentrated on paper or polymeric films because such materials are thin enough to be moved through inkjet printers and because the cost of such media is inexpensive relative to the image being produced and the end use of the media, such as temporary advertisements, personal computer color printed sheets, and the like.

However, natural wood surfaces, as distinguished from paper, can become suitable inkjet receptor media if one desires the increase the value of the underlying receptor media for a more permanent usage than found with paper or polymeric inkjet receptor media. But, coatings used for paper or plastic films unduly affect the natural wood surfaces. Such coatings would mar the natural appearance of the wood surface, including the grain of the wood, its natural color, fibrous texture, and the like.

SUMMARY OF INVENTION

This invention solves the problems encountered with using wood surfaces as inkjet receptor media by preparing and treating such wood surfaces to accept inkjet inks. This invention has utility for the production of inkjet image graphics on natural wood surfaces using conventional inkjet printers and conventional inkjet inks. As such, a completely new inkjet receptor medium can be available for selection by graphic artists to expand the usage of digital inkjet imaging to new markets and industries that use natural wood surfaces for presentation of information, ornamentation, and the like.

One aspect of the invention is an inkjet receptor medium comprising a natural wood surface having applied thereto an image fixing agent comprising an organo-metallic complex of a hydrophobic fatty acid coordinated with a halogenated trivalent chromium.

Another aspect of the invention is a method of preparing and treating a wood surface to become an inkjet receptor medium, comprising preparing the wood surface to receive an image fixing agent and treating the wood surface with the image fixing agent, wherein the image fixing agent comprises an organo-metallic complex of a hydrophobic fatty acid coordinated with a halogenated trivalent chromium.

Another aspect of the invention is an image graphic comprising an inkjet receptor medium having a wood surface as described above and an image formed of inkjet ink.

A feature of the invention is the retention of substantially all desirable properties of the wood surface while adding the benefit of it being capable of receiving an inkjet ink image therein and thereon without horizontal diffusion that could distort the inkjet image on the expensive wood surface.

Another feature of the invention is the ability to employ wood surfaced materials, such as veneers, to receive inkjet images in the substantially the same manner as employed by digital image graphic artists with paper or polymeric receptor media.

An advantage of the invention is the ability to create digital image graphics on a wood surface so that (1) such wood surface can mimic expensive woods for lamination on to less expensive woods, (2) such wood surface can create a customized digital image on natural wood surfaces, providing new decorating and interior design possibilities to users of digital inkjet printers, whether such users are ultimate home consumers or industrial operations in the building or home improvement industries, and (3) such wood surface can provide a more durable inkjet receptor medium for new applications of inkjet imaging where the natural grain and fibrous texture of wood is desired.

Another advantage is the ability of one skilled in the art to finish the imaged wood surface in the same manner as employed for the unimaged wood surface.

Other features and advantages will be explained in relation to the following embodiments of the invention.

EMBODIMENTS OF THE INVENTION

Wood Surface

Figure 1:
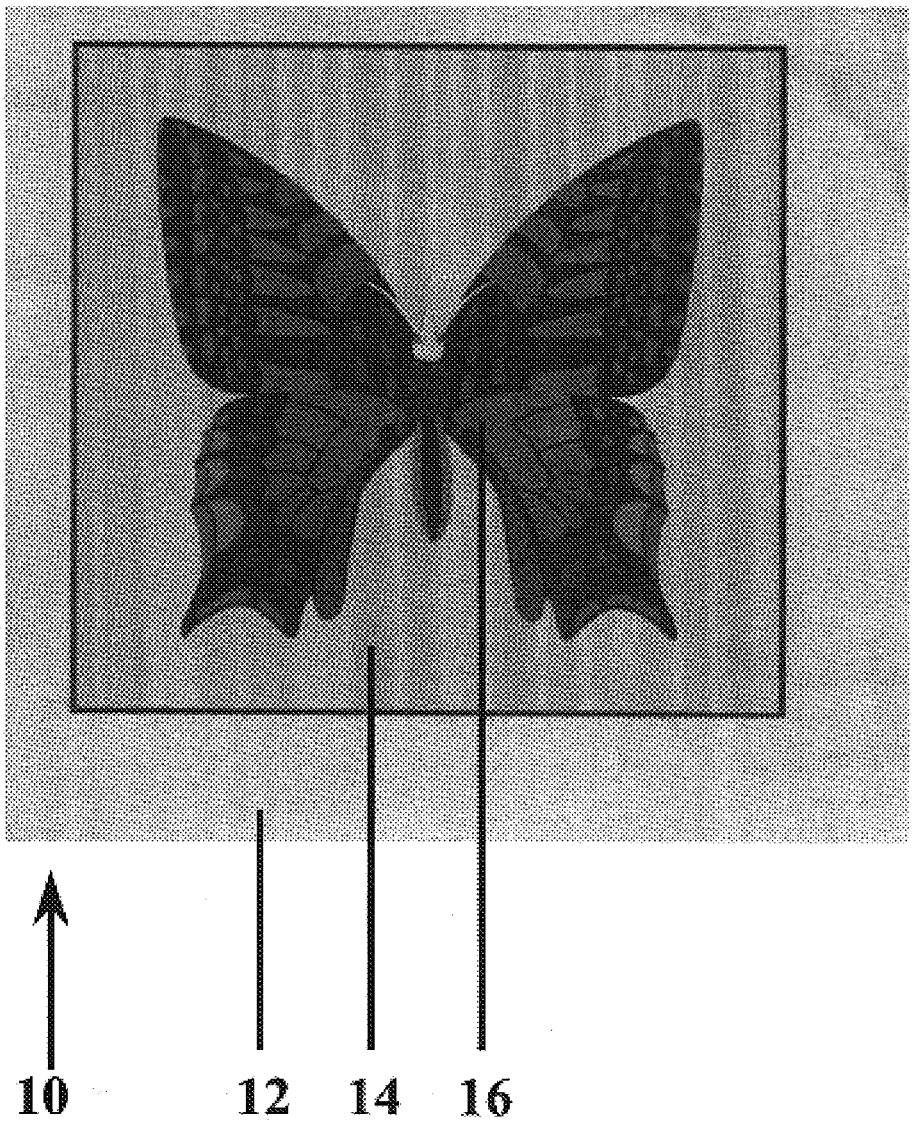
FIG. 1 is a top view of a color inkjet image printed on a wood surface prepared and treated according the present invention to be an inkjet receptor medium.

The present invention uses a natural wood surface to become an inkjet receptor medium. Wood surface includes without limitation veneers, plywoods, particle boards, and other products having at least one natural wood surface. These natural wood surfaces are distinguished from reconstituted cellulosic surfaces such as paper, because the original surface is desired for its natural, cellulosic fibrous wood characteristics. In that respect, the natural wood is unreconstituted cellulose fibers forming a natural texture and grain. While veneers are presently preferred because of their ability to move through conventional inkjet printers, as such inkjet printers continue to evolve, the use of other wood surfaces becomes more feasible, depending on ultimate usage of an image graphic on a wood surface.

For purposes of clarification, not limitation, the following wood products terms are defined by those skilled in the art, as published on the Internet at http://woodmosaic.com/encyclopedia/:

Veneer: A thin sheet of wood ranging in thickness from ⅛" to 1/100" (0.3 to 0.02 cm). Depending on the market, the standard thickness is 1/40" (0.06 cm), although it may vary from species to species.

Plywood: Any combination of veneers, lumber, core, paper or other material joined together with adhesive to make a one piece construction. Plywood can be of any thickness. Standards are ⅛", ¼", ½", ¾", or 1" (0.3, 0.6, 1.3, 1.9, or 2.5 cm). Hardwood plywood usually has a face, core and back.

Face: Any sheet of veneer made from various components that is exposed to view. Examples are wall paneling, desk tops, or counter fronts.

Inner Plies: Any piece or sheet of plywood other than the face and back.

Core: The inner ply of any plywood that has a face and back. The core can be made of lumber, particle board, medium density fiber board (MFD) veneer core, paper core, or resin.

Back: Sometimes called backing grade when referring to veneer. The material used on the reverse side of plywood from the face.

Particle Board: A panel of small fibers that are bonded together with adhesive, heat, and pressure.

Component: Individual sheets of veneer, both in width and length, used to make a face.

Layon: 'Jointed veneer' pieces forming a made-to-measure panel ready for application to a door or panel. It is produced by trimming the veneer to give it a straight edge so that it can be stitched together so as to create the width necessary to cover the surface which is to be veneered. A non-limiting variety of matches from a flitch can be employed to create a pattern on the veneer:

Flitch: Any part of a log that is produced for the purpose of cutting veneer.

Random Match: Sheets of veneer joined together with no definite pattern or color.

Center Matched: An even number of veneer pieces from the same flitch, with a definite line in the center, to show a definite pattern.

Butt Matched: Two pieces of veneer joined at the ends to produce a definite pattern.

Balance Match: Two or more pieces of veneer of equal length and width joined together to make a face.

Book Match: Equal pieces of veneer from the same flitch (½ log) joined together to produce a balanced and definite pattern.

Running Match: A face or panel made from components joined together without flipping through the entire flitch.

Slip Match: Pieces of veneer are slipped from the bundle or flitch without flipping.

The wood grain and other natural images on the face of the wood surface can be critical to the value of the wood for its ultimate use, particularly in wood paneling, fine furniture, and the like. Non-limiting examples of natural images include the following, using definitions from the same Internet site:

Blockmottle: A variegated pattern that looks like small blocks as opposed to crossfire or figure.

Cathedral: Grain pattern in the form of a "V" or inverted "V" running the length of the sheet.

Burl: A distortion or unusual growth within a log that results in a blister like grain. Very unusual and expensive. Used primarily for auto dashboards and fine furniture.

Cross Fire (also Figure or Flame): The appearance of shadows or waves that run across the grain of any species. Other terms such as fiddle back and curly also apply.

Veneers can be prepared using a number of different cutting techniques. As identified at the same Internet site, non-limiting examples include:

Flat sliced: Veneer is sliced parallel to the center of the flitch. This results in Cathedral Grain.

Rotary (Peeled): Veneer is peeled from whole log.

Quartered: Veneer is sliced perpendicular to the growth ring. This results in Wild Grain.

Drift Cut: Similar to quarter cut. Normally only cut from Large oak logs to achieve a straight grain veneer.

Half Round: Cut on a half round machine to produce a flat cut effect, and to avoid defective or dark heart woods.

Lengthwise Sliced: Cut on a Japanese machine from flat sawn lumber. Used for thicker veneers.

Woods used for faces of veneers, plywoods, and particle boards, i.e., natural wood surfaces of the present invention, can be either hardwood species or softwood species. Non-limiting examples of hardwoods include: White Ash, Afromosia, Anegre, European Beech, White Birch, Bubinga, Cherry, Chesnut, Cypress, Eucalyptus, Hickory, Koto, Honduras Mahogany, African Mahogany, White Maple, Curly Maple, Birds Eye Maple, Red Oak, White Oak, Pear, Pecan, White Poplar, Rose, Sapeli, Teak, Tupelo, and Walnut. Non-limiting examples of softwoods include: Carolina Pine, Knotty Pine, Clear White Pine, Red Pine, Hemlock, Douglas Fir, and Yew. ps Optional Adhesive Layer and Optional Liner When the wood surface receptor medium is a veneer, it optionally but preferably has an adhesive layer on its opposite major surface that is also optionally but preferably protected by a protective release liner. After imaging, the receptor medium can be adhered to a horizontal or vertical, interior or exterior surface to decorate, warn, educate, entertain, advertise, etc.

Commercially available sources of veneers, plywoods, and particle boards are well known to those in the wood products industries. Convenient vendors include without limitation, Cloverdale Company of Cloverdale, Va., and Woodtape Inc. of Everett, Wash. A particularly preferred veneer product is a laminate of maple wood with adhesive and veneer paper liner commercially available from Woodtape Inc.

The choice of adhesive and release liner depends on usage desired for the image graphic. For example, a wood surface of veneer can be laminated to a less expensive wood structure to provide a more valuable outer appearance of the face of the veneer.

Pressure sensitive adhesives can be any conventional pressure sensitive adhesive that adheres to both medium and to the surface of the item upon which the inkjet receptor medium having the permanent, precise image is destined to be placed. Pressure sensitive adhesives are generally described in Satas, Ed., Handbook of Pressure Sensitive Adhesives 2nd Ed. (Von Nostrand Reinhold 1989), the disclosure of which is incorporated by reference. Pressure sensitive adhesives are commercially available from a number of sources. Acrylate pressure sensitive adhesives are commercially available from Minnesota Mining and Manufacturing Company of St. Paul, Minn. and generally described in U.S. Pat. Nos. 5,141,797, 4,605,592, 5,045,386, and 5,229,207 and EPO Patent Publication EP 0 570 515 B1 (Steelman et al.).

Liners are also well known and commercially available from a number of sources. Nonlimiting examples of liners include veneer backing paper (which remains adhered during final lamination to the target material or project) and release liners (removed to expose adhesive for that final lamination), such as silicone coated kraft paper, silicone coated polyethylene coated paper, silicone coated or non-coated polymeric materials such as polyethylene or polypropylene, as well as the aforementioned base materials coated with polymeric release agents such as silicone urea, urethanes, and long chain alkyl acrylates, such as defined in U.S. Pat. Nos. 3,957,724; 4,567,073; 4,313,988; 3,997,702; 4,614,667; 5,202,190; and 5,290,615; the disclosures of which are incorporated by reference herein and those liners commecially available as Polyslik brand liners from Rexam Release of Oakbrook, Ill., U.S.A. and EXHERE brand liners from P. H. Glatfelter Company of Spring Grove, Pa., U.S.A.

The combination of adhesive layer and protective release liner can be adhered to the back of the veneer or natural other wood surface using techniques known to those skilled in the art, including without limitation, use of transfer adhesive sheets available from 3M to application of liquid wood glues followed by application of paper liners.

Treated Wood Surface

The wood surface is prepared according to the following technique: The target material, a natural wood product in the form of veneer, laminate, board, composite, etc. should be clean and relatively smooth and free from defects. A smoothness obtained by using a 320 grit wet or dry sandpaper or its approximate equivalent abrasive material is sufficient, with either mechanical or manual sanding techniques being employed.

The treatment of the image fixing agent can be applied by rubbing into the wooden face surface with a dampened cloth or sponge, or by any other manual or mechanized application method such as brushing, spraying, painting or other dispersion techniques known to those skilled in the art, including a knife (notch bar) coater or equivalent (e.g. at 3 mil (0.76 mm) between 0.3% and 4% etc.) or using gravure coating or other coating procedures known in the art. Immersion of the wooden face surface is not necessary nor recommended. The wooden face surface should be as totally and as evenly covered as possible. The surface is then allowed to thoroughly dry. Some application of pressure can be needed to restore a flatness to the natural wood surface. The drying time can be speeded up by application of a slight amount of heat or moving air, or a combination of both.

Once the treated material is dry, it must be finish sanded in such a way as to leave the surface as smooth and as even as possible, preferably sanding in both grain and cross-grain directions. The finish sanding can be accomplished in several different ways depending upon the nature of the material. Mechanical or hand sanding can be used. The grit can range from about 320 to about 600 on the wet or dry sandpaper, depending on the species of the wood on the face surface. Because of the many variables involved with natural wood products, the exact methods and materials will be adjusted according to experience of those skilled in the art of finished wood preparation to obtain the desired results. The finished product should then have any sanding dust or other materials carefully removed from the surface. This can be accomplished by vacuuming, forced air, a tack cloth, or any combination thereof. When properly processed, the prepared, treated wood face surface will successfully accept an digital image created from most standard inkjet printers, when the proper printer settings are used.

Image fixing agents useful for the present invention are based on an active ingredient in an aqueous solution or mixture, namely an organo-metallic complex of a hydrophobic fatty acid coordinated with a halogenated trivalent chromium.

The complex includes a trivalent chromium ion that forms a coordinate complex with the fatty acid. It is presently theorized that the complex has a chemical structure as follows:

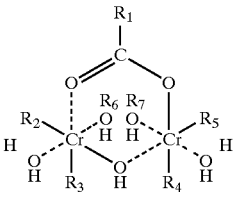

wherein: $R_1$ represents a $C_{10}$–$C_{20}$ fatty acid radical; $R_2$ to $R_5$ are alike or different and represent a halogen; and $R_6$ and $R_7$ are alike or different and represent a $C_1$–$C_5$ lower alkyl group. Preferably, $R_1$ is a $C_{13}$–$C_{17}$ fatty acid radical, $R_2$ to $R_5$ are chlorine and $R_6$ and $R_7$ are both alkyl groups containing three carbon atoms. The fatty acid radical is selected to contribute to the image fixing ability of the solution and can be from a $C_{14}$–$C_{18}$ fatty acid. Representative halogens are elements of Group VIIA of the Periodic Table and include fluorine, chlorine, bromine, iodine and astatine. Chlorine is the preferred halogen.

Representative complexes include: chromium, pentahydroxy(tetradecanoato)di-; tetradecanoato chromic chloride hydroxide (1:2:4:1); octadecanoato chromic chloride hydroxide (1:2:4:1); the like and mixtures thereof.

Representative of commercially available complexes is the QUILON® family of chrome complexes from DuPont Chemicals, Wilmington, Del.

Optionally, the water can have a reduced pH, preferably where the reduction is accomplished by a halogen-ion-containing component. A solution of this type is disclosed in U.S. Pat. No. 5,486,231 (Dulaney) for water repellency. As explained in Dulaney, the solution is very, stable and has a long shelf life. It is critical to reduce the pH of the water prior to mixing with the complex. Preferably, the reduced pH water has a pH in the range of about 0.5 to about 2.0. Commercially available quantities of this solution are available from Cash Coatings Company, Inc. of Madison, Wis., under the brand name Duralose™.

Optionally, the solution can have additives such as surfactants to assist the treatment of the wood surface. The surfactant can be ionic (cationic or anionic) or nonionic and are available in each form from a number of commercially available vendors known to those skilled in the art. One source of information about surfactants is located on the Internet at http://surfactants.net.

The nonionic surfactants are usually condensation products of an organic aliphatic or alkylaromatic hydrophobic compound and an alkylene oxide, such as ethylene oxide, which is hydrophilic. Almost any hydrophobic compound having a carboxy, hydroxy, amido, or amino group with a free hydrogen present can be condensed with ethylene oxide to form a nonionic surfactant. Useful nonionic surfactants include those selected from the group consisting of non(co) polymerizable nonionic surfactants, ethylenically-unsaturated copolymerizable nonionic surfactants, and mixtures thereof. Nonlimiting examples of such nonionic surfactants include Triton X-100, Triton X-102, Triton X-114, Triton X-101, and Triton CF-10 surfactants (all available from Union Carbide Corporation); Surfynol 104, Surfynol 104BC, Surfynol 465, and Surfynol TG surfactants (all available from Air Products and Chemicals of Allentown, Pa.) and Tergitol NP-9 and Tergitol NP-10 surfactants (both available from Union Carbide Chemicals and Plastics Co. of Danbury, Conn.).

Anionic surfactants normally include a hydrophobic moiety selected from the group consisting of about $C_6$ to about $C_{20}$ alkyl, alkylaryl, and alkenyl groups and an anionic group selected from the group consisting of sulfate, sulfonate, phosphate, polyoxyethylene sulfate, polyoxythylene sulfonate, polyoxethylene phosphate and the alkali metal salts, ammonium salts, and tertiary amino salts of such anionic groups.

Cationic surfactants useful in the present invention include but are not limited to those selected from the group consisting of quaternary ammonium salts in which at least one higher molecular weight group and two or three lower molecular weight groups are linked to a common nitrogen atom to produce a cation, and wherein the electrically-balancing anion is selected from the group consisting of a halide (bromide, chloride, etc.), acetate, nitrite, and lower alkosulfate (methosulfate etc.). The higher molecular weight substituent(s) on the nitrogen is/are often (a) higher alkyl group(s), containing about 10 to about 20 carbon atoms, and the lower molecular weight substituents may be lower alkyl of about 1 to about 4 carbon atoms, such as methyl or ethyl, which may be substituted, as with hydroxy, in some instances. One or more of the substituents may include an aryl moiety or may be replaced by an aryl, such as benzyl or phenyl. Among the possible lower molecular weight substituents are also lower alkyls of about 1 to about 4 carbon atoms, such as methyl and ethyl, substituted by lower polyalkoxy moieties such as polyoxyethylene moieties, bearing a hydroxyl end group, and falling within the general formula $$—R(CH_2CH_2O)_{n-1}CH_2CH_2OH$$

where —R is $C_{1-4}$ divalent alkyl group bonded to the nitrogen, and n represents an integer of about 1 to about 15. Alternatively, one or two of such lower polyalkoxy moieties having terminal hydroxyls may be directly bonded to the quaternary nitrogen instead of being bonded to it through the previously mentioned lower alkyl.

Further recitation of surfactants can be found in U.S. Pat. No. 5,670,557 (Dietz et al.), the disclosure of which is incorporated by reference herein.

Further optionally, additives to mask the nature of the active ingredient can be included in trace amounts to minimize identification by chemical analysis of the image fixing agent.

Water is preferably distilled or deionized to minimize undesirable interaction of trace quantities of chemicals in tap water with the active ingredients of the image fixing agent.

The image fixing agent can contain the chrome complex in an amount in the range of about 1.0 to about 10.0 weight percent (wt %), the water in an amount in the range of about 90 to about 98 wt % and the optional pH reducing component or optional surfactant in an amount in the range of about 0.0 to about 1.0 wt %, the weight percents being based on the total weight of the image fixing agent. Preferably, the image fixing agent is in an amount of about 2 to about 5 wt %.

As explained in Dulaney, a mixture of hydrochloric acid and sodium hypochlorite in a weight ratio range of about 1:1 to about 3:1 is a preferred halogen-containing component. Preferably, the hypochlorite is present in the water repellent solution in an amount in the range of about 150 to about 450 parts per million. The volatile organic chemical (VOC) content of the solution preferably is 0 to about 10, more preferably 0 to about 5, wt %.

The image fixing agent can be prepared at ambient temperature, i.e., a temperature in the range of about 65° to about 85° F. (18 to 29° C.), using a suitable vessel. The water and pH reducing component or surfactant, as the case may be, are introduced into the vessel with mixing. Then, the complex is introduced while maintaining mixing. After a substantially homogeneous solution is produced, the mixing is stopped and the solution packaged, preferably in an air-tight container.

The amount of image fixing agent applied to the dried, prepared wood surface can range from about 300 to about 500 $cm^2$ of surface per milliliter of image fixing agent, and preferably about 390 $cm^2$/ml (approximately 1600 $ft^2$/gallon).

As explained in Dulaney, it is theorized by Dulaney that the hydroxyl groups of the wood cellulose react with the chromium-containing part of the complex and bond thereto to form a treatment that is ideally only one molecule thick. The fatty acid is oriented away from the wood surface and provides the water repellent characteristic of the solution that Dulaney desired. Unexpectedly, the property of image fixing for inkjet inks, to minimize undesirable drop spreading, is also provided.

USEFULNESS OF THE INVENTION

Wood surface receptor media of the present invention can be employed in any environment where inkjet images are desired to be precise, stable, and rapid drying. With the ability to create digital images on a wood surface, the use of a lesser value wood surface can be used to simulate a higher value wood surface. For example, use of a Northern Hemisphere wood in greater quantity and lesser expense (such as a renewable, cultivated wood species like maple) can be imaged to create the appearance of an exotic Southern Hemisphere wood (such as mahogany) to be used as a veneer for furniture, modular wood constructions, wood paneling, and the like. The environmental and economic benefits of using maple wood to create the appearance of mahogany can not be overstated. The beauty of creating a wood inlaid pattern on a common wood via digital imaging to give the appearance of an intricate pattern of exotic woods also can not be overstated.

The digital image process can be used to create the appearance on the wood surface of any of the grains or natural images identified above in any of the matches identified above. The creativity of a skilled image graphic artist can be employed to provide a considerable value added to commercial furniture and wood industries that presently use veneers, plywoods, or particle boards, with the face of the wood surface carrying a digitally prepared inkjet image of the appearance of a more valuable wood, especially those wood species that are threatened with overuse and subject to international trade restrictions.

From the high volume veneer industry to the home computer for the individual hobbyist, one can employ wood surface inkjet receptor media of the present invention according to standardized or customized images in a variety of sizes. The capacity of the inkjet printer to accept area sizes of media is the only limitation. As personal computer printers become more robust and large format printers become faster, one can use digital imaging techniques with a limitation of only the horizon of the imagination. For example, with the use of a digital camera, one can create a customized decoration on wood paneling in a home, where the home owner provides the digital image to a large format inkjet printing company.

Inkjet receptor media of the present invention can accept a variety of inkjet ink formulations to produce rapid drying and precise inkjet images. Commonly, inkjet ink formulations have pigments in water blended with other solvents. Both water and the other solvents carry the pigments to the wood surface. The presence of the image fixing agent, applied to the natural wood surface of a face of a wood product, forms a precise image.

FIG. 1 shows an example of the wood surface inkjet receptor medium of the present invention. The medium 10 is a laminate of a wood surface 12 made of maple and an adhesive layer protected by a release liner. The laminate veneer is commercially available from Woodtape, Inc. of Everett, Wash. and has been subsequently prepared and treated according to methods of the present invention. On wood surface 12 are two images, one 14 which shows a wood grain indicating how a wood surface 12 can take on the appearance of a curly or Tigerstripe maple wood veneer. The second image 16 is of a butterfly and shows how the wood surface 12 can be customized, even within the first image 14 to provide a four-color image.

The example shown in FIG. 1 was prepared using Epson dye-based ink in an Epson 1520 printer with a Personal Computer using a Windows 95/98 operating system and Corel Draw Imaging Software. Image 14 was obtained by creating the image in Corel Draw and storage into a digital file. Image 16 was obtained from Corel ClipArt software. Settings in the imaging software to produce image 14 and image 16 were based on personal preferences of optical optimization.

Alternatively, the formation of precise inkjet images is provided by a variety of commercially available printing techniques. Nonlimiting examples include thermal inkjet printers such as the Bubble Jet brand series of printers from Canon Corporation; Hi-Fi Jet brand printers from Roland Corporation; DeskJet brand, PaintJet brand, Deskwriter brand, DesignJet brand, and other printers commercially available from Hewlett Packard Corporation. Also included are piezo type inkjet printers such as those from Seiko-Epson, spray jet printers and continuous inkjet printers. Any of these commercially available printing techniques introduce the ink in a jet spray of a specific image into the medium of the present invention.

Inkjet imaging techniques have become very popular in commercial and consumer applications. The ability to use a personal computer and desktop printer to print a color image on paper or other receiving substrate has extended from dye-based inks to pigment-based inks. The latter provide brilliant colors and more durable images because pigment particles are more durable than dyes on the receiving substrate. Such inks are used in thermal and piezo printing formats.

Thermal inkjet print heads are commercially available from Hewlett Packard Corporation or LexMark Corporation in inkjet printers commercially available from Hewlett Packard Corporation, Encad Inc., Mimaki Corporation, Mutoh, and others.

Piezo inkjet print heads are commercially available from Topaz Technologies (Sunnyvale, Calif.), Epson Corporation (Torrance, Calif.). Data Products (Woodland Hills, Calif.), Modular Ink Technologies (Dallas, Tex.), and others. These printheads differ in physical properties such as frequency and drop volume and the inks to be used in them often require different physical properties such as viscosity. Such print heads are used in piezo inkjet printers commercially available from Idanit Technologies, Ltd. of Rishon Le Zion Israel; Raster Graphics of San Jose, Calif.; Vutek Inc. of Meredith, N.H.; Olympus Optical Co. Ltd. of Tokyo, Japan and others.

Thermal inkjet inks are commercially available from a variety of sources, including Hewlett Packard Corporation, Lexmark Corporation, and the like. Piezo inkjet inks are commercially available from 3M, including those disclosed in U.S. Pat. No. 6,113,679 (Adkins et al.).

Piezo inkjet printing principally relies on the use of four colors: cyan, magenta, yellow, and black (CMYK). However, to improve resolution of images, some printers identified above also add two additional colors that are less concentrated relatives of the cyan and magenta inks, called "light cyan" and "light magenta." Additionally, printers and software can be configured to use "special" or "spot" colors that are specific hues based on large usage or commercial branding requirements.

Print heads deliver ink drops in sizes ranging from about a nominal 10 pL to about a nominal 150 pL and preferably from about a nominal 20 pL to about a nominal 70 pL. Resolution of the inkjet image graphic ranges from about 200 dots-per-inch (dpi) to about 1440 dpi and preferably from about 600 dpi to about 1200 dpi.

Because of the simplicity of operation, economy of inkjet printers, and improvements in ink technology, the inkjet imaging process holds a superior growth potential promise for the printing industry to produce wide format, image on demand, presentation quality durable graphics. Now with the ability to print on natural wood surfaces with substantially the same image precision and printing speed as on paper or polymeric media, only the imagination of the image graphic artist limits the usefulness of the present invention.

For digital printing, the surface of the veneer should be as clean and free from dirt and oils as possible. Preferably, a single sheet is loaded with the printer set for the maximum printable material thickness possible. On some printers it is the thickness for printing cardstock or envelopes. The printer rollers should be kept clean, and the edges of the veneer should be checked that they have not been damaged during transportation or handling. Preferably, unprinted, treated veneer should be stored the veneer in its plastic bag under a stack of books or other weight to maintain flatness of the media before use in the printer.

A test run of the intended image should be printed on the veneer in one of the corners to check the image quality and consider if any changes might be needed, remembering that unlike paper or polymeric sheets, the digital printing is going on to a face surface that is not white in color. Some color change adjustments may be needed to obtain the desired results. Also, using computer software to alter the colors and transparency of the digital image can be manipulated to achieve some very interesting and attractive results.

Usually, one can use of the printer's standard settings for the most detailed images possible. However, some printers are capable of controlling the amount of ink applied to the face surface. The setting for the amount of ink used is usually controlled by the type of material to be printed on. Preferably, for those printers, use of the least amount of ink possible usually obtains the most acceptable results. A user of inkjet receptor media of the present invention must also realize that many different printers and inks are now commercially available, requiring some review, without undue experimentation, before completing the final digital imaging of the media.

After printing, the desired image successfully the printed material should be handled carefully and allowed to fully dry. A spray finish should preferably be used to protect the printed veneer. Use of finishing oils or brush coatings of any finish are not recommended because of the possibility of distortion of the digital image. An alternative method is to seal the images with a number of different spray finishes and then proceeded to apply a brushed finish as an overcoat or final finish. Alternatively, one can use self-adhesive laminating plastic to cover the image graphic. Representative examples of "protective clears" as laminates include those disclosed in U.S. Pat. No. 5,681,660 (Bull et al.), the disclosure of which is incorporated herein by reference.

Those skilled in the art will recognize the many conventional methods to attach veneer to the target material or project. Almost any type of wood glue or contact adhesive will work. Using a clean sheet of protective paper to cover the veneer will protect it while applying pressure to form the bond of the media to the underlying surface. It can be of some help to apply several spray coats of finish to the veneer before attaching the veneer to the target material or project. More finish can then be applied to the project once the veneer is in place. Double-faced adhesive films are a preferred way to apply veneers to another object. Testing a smaller scale lamination is advisable before attempting something on a larger scale.

Unexpectedly, the presence of the image and the image fixing agent in the wood surface does not adversely affect the finish treatment desired for natural wood surfaces. Inkjet receptor media of the present invention become a means of transforming almost any article into a natural wood surface having a digital image.

The underlying surface can be planar, a simple curved surface, and in some instances depending on the type of veneer, a compound curved surface. The underlying surface can be almost any article to be decorated with a finely crafted wood image. Nonlimiting examples of such articles include billiard cues sticks, refrigerator door panels, fine furniture, modular office partitions, wall paneling, coffins, flooring, cabinets, interior surface wood trim, and the many other articles known to those skilled in the art of woodworking, home construction, hobby crafts, and other industries.

The invention is not limited to the above embodiments. The claims follow.

What is claimed is:

1. An inkjet receptor medium, comprising:

a natural wood surface having applied thereto an image fixing agent comprising an organo-metallic complex of a hydrophobic fatty acid coordinated with a halogenated trivalent chromium, wherein the wood surface is a face of a veneer, a plywood, or a particle board.

2. The inkjet receptor medium of claim 1, wherein the image fixing agent has a chemical structure of

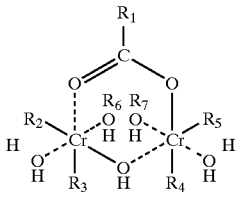

wherein: $R_1$ represents a $C_{10}$–$C_{20}$ fatty acid radical; $R_2$ to $R_5$ are alike or different and represent a halogen; and $R_6$ and $R_7$ are alike or different and represent a $C_1$–$C_5$ lower alkyl group.

3. The inkjet receptor medium of claim 2, wherein the image fixing agent is selected from the group consisting of chromium, pentahydroxy(tetradecanoato)di-; tetradecanoato chromic chloride hydroxide (1:2:4:1); octadecanoato chromic chloride hydroxide (1:2:4:1); and combinations thereof.

4. The inkjet receptor medium of claim 1, wherein the image fixing agent has a coverage of from about 300 to about 500 $cm^2$ of surface per milliliter of image fixing agent.

5. The inkjet receptor medium of claim 1, wherein the wood surface is selected from the group consisting of White Ash, Afromosia, Anegre, European Beech, White Birch, Bubinga, Cherry, Chesnut, Cypress, Eucalyptus, Hickory, Koto, Honduras Mahogany, African Mahogany, White Maple, Curly Maple, Birds Eye Maple, Red Oak, White Oak, Pear, Pecan, White Poplar, Rose, Sapeli, Teak, Tupelo, Walnut, Carolina Pine, Knotty Pine, Clear White Pine, Red Pine, Hemlock, Douglas Fir, and Yew.

6. The inkjet receptor medium of claim 1, wherein the wood surface is a face of a veneer and further comprising an adhesive layer on a major surface opposing the wood surface.

7. The inkjet receptor medium of claim 6, further comprising a liner covering the adhesive layer.

8. The inkjet receptor medium of claim 7, wherein the veneer is maple wood.

9. An imaged graphic, comprising a natural wood inkjet receptor medium of claim 1 and an image formed of inkjet ink.

10. The image graphic of claim 9, wherein the inkjet ink is selected from cyan, magenta, yellow, black, and combinations thereof.

11. The image graphic of claim 9, wherein the inkjet ink creates an image of natural wood of one species on the natural wood surface of a second species.

* * * * *